United States Patent [19]

Hausknecht

[11] 4,134,371

[45] Jan. 16, 1979

[54] VALVE CONTROL SYSTEM

[76] Inventor: Louis A. Hausknecht, 4504 State Rd., Cleveland, Ohio 44101

[21] Appl. No.: 791,691

[22] Filed: Apr. 28, 1977

[51] Int. Cl.[2] ..... F01L 1/24

[52] U.S. Cl. ..... 123/90.43; 123/90.15; 123/90.16; 123/90.46; 123/90.55

[58] Field of Search ..... 123/90.55, 90.56, 90.57, 123/90.58, 90.46, 90.43 I, 90.15, 90.16, 90.13

[56] References Cited

U.S. PATENT DOCUMENTS

| | | | |
|---|---|---|---|
| 1,931,476 | 10/1933 | Hallett | 123/90.46 |
| 2,019,252 | 10/1935 | Cottingham | 123/90.55 |
| 2,815,012 | 12/1957 | Sampietro | 123/90.43 |
| 3,385,274 | 5/1968 | Shunta et al. | 123/90.55 X |
| 3,490,423 | 1/1970 | Shunta et al. | 123/90.55 X |
| 3,518,976 | 7/1970 | Thuesen | 123/90.56 X |
| 4,020,806 | 5/1977 | Aoyama et al. | 123/90.55 |

FOREIGN PATENT DOCUMENTS

| | | | |
|---|---|---|---|
| 1399813 | 7/1975 | United Kingdom | 123/90.55 |

*Primary Examiner*—Ronald H. Lazarus
*Assistant Examiner*—Jeffrey L. Yates
*Attorney, Agent, or Firm*—Reese Taylor

[57] ABSTRACT

A variable control mechanism for regulating the opening of an engine valve during each cycle of operation is disclosed. The control mechanism essentially includes hydraulic restraint means which control the relationship between camshaft movement and valve opening in an operating train wherein rotary motion of the camshaft is translated into linear movement of the valve. One form of the invention includes a pivotable rocker arm, one end of which is operatively connected to the cam shaft by a cam follower and push rod and the other end of which is operatively connected to the valve. Effective movement of the rocker arm to actuate the valve is controlled by a hydraulic system, including a movable sleeve the operation of which is controlled by varying hydraulic pressures so that by increasing or decreasing the hydraulic pressure the opening of the cylinder valve can be controlled. Another form of the invention eliminates the rocker arm and controls opening of the valve by hydraulically varying the timing between camshaft movement and the transfer of hydraulic pressure to the valve.

4 Claims, 5 Drawing Figures

VALVE CONTROL SYSTEM

FIELD OF THE INVENTION

This invention, in general, relates to the valves of an internal combustion engine and, in particular, relates to the timing and lift of the valves by means of a hydraulic restraint system.

DESCRIPTION OF THE PRIOR ART

In most automotive engines, it is conventional to employ a crankshaft rotated in response to the firing of the various cylinders. The crankshaft, in turn, is connected to a camshaft which is provided with cam followers and push rods which serve, through appropriate connections and linkages, to open and close the engine valves for purposes of admitting fresh charges of fuel into the cylinders.

It is often desirable to vary the time and amount of valve opening and the extent of time that the valves are in the open position during each cycle of operation to accommodate varying operational conditions. Applicant's earlier U.S. Pat. No. 3,612,015 discloses one means of accomplishing this by means of a closed hydraulic system involving a reciprocal slave cylinder, a reciprocal master cylinder and certain control means. The system shown therein controls the allocation of fluid volume within the hydraulic circuit so as to regulate the movement of the slave cylinders and thus the valve opening.

Gavasso U.S. Pat. No. 3,413,965; Arutunoff U.S. Pat. Nos. 3,261,338 and Forstner 2,954,017 also show apparatus for controlling the operational "event" of valves of this type.

While a system such as shown in U.S. Pat. No. 3,612,015 has been found acceptable, it has also been discovered that improved means can be provided for controlling the valve timing and lift or, in other words, controlling the period of time the valves are open on each cycle, sometimes referred to as the operational "event."

SUMMARY OF THE INVENTION

Essentially, it has been discovered that the relationship between camshaft movement and valve opening can be controlled by varying hydraulic pressure acting within the operational train. It has been found that hydraulic pressure can be employed to permit greater or lesser movement of the cam and camshaft before that movement is translated into valve movement.

Thus, it has been discovered that improved results can be obtained by employing a pivotable rocker arm, one end of which is operatively associated with the push rod and cam follower of the camshaft so that upon rotation of the same the rocker arm will be moved linearly. It has been found that the other end of the rocker arm can be operatively associated with the valve so that after a certain predetermined amount of linear movement of the arm the valve will be opened.

In this regard, it has been discovered that by employing a hydraulic valve control system with a slidable sleeve bearing on the rocker arm that the amount of linear movement of the rocker arm in response to pressure from the cam follower prior to pivoting of the arm and opening of the valve can be controlled so that effectively a "lost motion" effect can be achieved. The degree of such movement can be controlled by controlling the pressure of the oil or other hydraulic fluid forced into the control system and thereby controlling the position of the sleeve.

It has also been found that, if desired, the rocker arm can be eliminated and the hydraulically controlled sleeve can be employed in conjunction with a master cylinder piston carried by the push rod to variably control closure of the system and control the valve operational event.

Accordingly, production of a valve control system of the type above described becomes the principal object of this invention, with other objects thereof becoming more apparent upon a reading of the following brief specification, considered and interpreted in view of the accompanying drawings.

DESCRIPTION OF THE PREFERRED EMBODIMENTS

Figure 1:
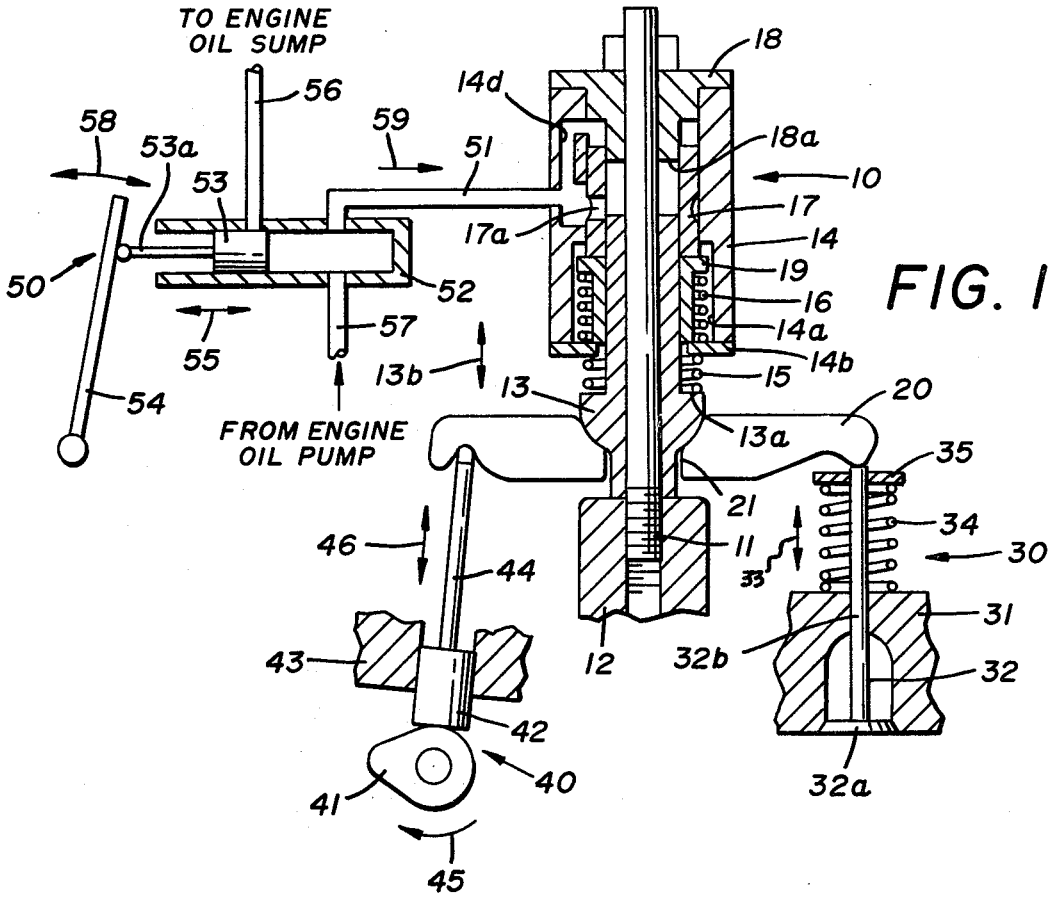
FIG. 1 is a sectional view, partially in schematic form, showing the preferred form of the invention, prior to operation, set for maximum valve opening.

Referring first then to FIG. 1, it will be noted that the main components of the principal embodiment of the invention include a hydraulic valve assembly 10, a rocker arm 20, engine valve assembly 30, a cam and cam follower assembly 40, and a hydraulic system assembly 50.

Engine valve assembly 30 is essentially conventional in nature and includes a housing 31 with a valve member 32 being reciprocal therein to either open or close the valve. Valve 32 includes a stem **32*b* and a head 32*a* with the head, of course, closing off the valve opening of valve assembly 30** or opening the same depending upon positioning thereof.

A spring retainer 35 is also provided, and a spring 34 surrounds the stem **32*b* and is trapped between the top of the housing 31 of valve assembly 30 and the retainer 35. The end of the stem 32*b* is in contact with one end of rocker arm 20, as clearly shown in the drawings, so that movement of the arm 20 downwardly in the direction of the arrow 33 will force the valve to the open position while the spring 34 will normally tend to force it to the closed position as shown in FIG. 1**.

The cam and cam follower assembly 40 is also essentially conventional in that it includes a cam 41 mounted on the camshaft for rotational movement in the direction of the arrow 45. A cam follower 42 rides on the surface of the cam 41 and is movable linearly in the direction of arrow 46 in response to movement of the cam 41. One end of the push rod 44 is connected to cam follower 42 and the opposed end is operatively connected to the rocker arm 20 so that movement thereof in the upward direction of arrow 46, as the cam rotates, will tend to force the rocker arm 20 upward in the direction of the arrow **13*b***.

Were the rocker arm 20 fixed at its pivot point, any movement in the direction of arrow 46 of the cam and cam follower assembly would tend to pivot the rocker arm 20 about its midpoint, driving its opposed end in a downward direction and opening the valve.

The essence of the present invention, however, is to control the relative movement between the cam follower 42 and the valve 32 by permitting the rocker arm to move upward in the direction of the arrow 13*b* a predetermined distance before such movement is halted and the arm is permitted to pivot, thereby opening the valve. In essence, the pivot point of the rocker arm is controlled and adjusted in this fashion to effect the time and amount of valve opening.

In order to achieve this, the valve assembly 10 and hydraulic control assembly 50 are employed.

Hydraulic control assembly 50 includes a housing 52 with a line 51 running from that housing to the valve assembly 10. A line 57 runs into the housing 52 from the engine oil pump, and a line 56 runs from the housing 52 to the engine oil sump. Reciprocally received within housing 52 is a piston 53 having a piston rod 53*a* attached thereto and controlled by a lever 54. The lever 54 would presumably be located in the driving compartment of the automobile or other vehicle so that it would be readily and easily actuated by the vehicle operator in the direction of the arrow 58 to move the piston 53 in the direction of arrow 55. In this fashion, when the piston 53 moves past line 56 and closes it off, oil is forced into the valve assembly 10 by the engine oil pump under full pressure. When the piston is retracted so that line 56 is open, the hydraulic pressure built up in the valve assembly 10 is reduced, and some of the oil is permitted to return to the sump. The operative effect of this system on the engine valve timing will be discussed in greater detail below.

It should, however, be noted that in FIG. 1, for example, line 56 is completely closed off and, therefore, oil is being forced through line 51 in the direction of arrow 59 under maximum pressure. The amount of pressure is significant since it has a direct bearing on the operation of the system as will be described.

It should also be noted that the lever type operation that has been shown and described is illustrative only and that other means for controlling the pressure can be employed. For example, an indirect automatic means such as a solenoid, a vacuum diaphragm responsive to the manifold vacuum or to the carburetor venturi vacuum could be used. The control means could be also used to a greater degree to effect throttling directly by the engine valves themselves.

Turning next then to valve assembly 10, it will be noted that this generally includes a housing 14 having a fixed rod 11 passed centrally there through and secured to engine head 12.

A bell-shaped fulcrum member 13 is slidably received on the rod 11 and is reciprocal therealong in the direction of arrow 13*b*. It should be noted here that the rocker arm 20 has a central aperture 21 contoured so as to seat against the bottom of the fulcrum member 13 so that movement of the rocker arm 20, as will be described in greater detail below, will also result in movement of the fulcrum member 13 in the direction of arrow 13*b*.

Valve housing 14 has a first bore 14*a* which contains a spring 16. This spring has one end seated against the lower lip 14*b* of housing 14. A flanged bushing 19 is slidably carried on fulcrum member 13 and the other end of spring 16 is seated against the bottom of the flange of bushing 19 so that the spring will normally urge bushing 19 away from lip 14*b*.

Figure 4:
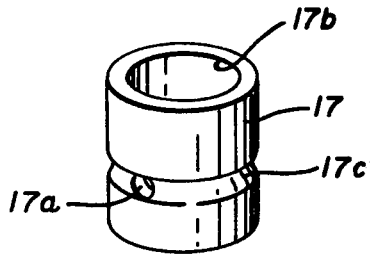
FIG. 4 is an enlarged perspective view of the operating sleeve.

Referring to FIGS. 1 and 4 it will be seen that operating sleeve 17 is an elongate cylindrical member having an axial central opening 17*b* so that it can be slidably received on fulcrum member 13. A radial opening 17*a* is also provided in the wall of the sleeve and an annular groove 17*c* is formed about the periphery and in communication with opening 17*a*. As noted, sleeve 17 is cylindrical in nature and is telescoped on fulcrum member 13 and within the valve body 14. The spring 16 and bushing 19 will prevent the sleeve 17 from moving in an uncontrolled fashion to the bottom of the valve housing 14 and will serve to retain it within the housing.

A second spring 15 is also employed in surrounding relationship to the fulcrum member and rests against the bottom of the lip 14*b* and on the top of the ledge 13*a* of the fulcrum member. This spring will tend to force the fulcrum member to the position shown in FIG. 1 unless the force of the spring is overcome, as will be described below.

As noted, sleeve 17 is cylindrical in nature and has an aperture 17a on one side thereof. Furthermore, the valve housing 14 has a second internal axial bore 14*d* which is in communication with line 51. In this fashion, oil forced into line 51 by the engine oil pump will flow into the valve housing and, in particular, into the bore 14*d* thereof and act on the top of sleeve 17. This oil also will flow through opening 17*a* and fill the space within the sleeve between the sleeve and the rod 11.

As illustrated in the position shown in FIG. 1, piston 53 has closed off line 56 and therefore maximum pressure exists in line 51. This causes the sleeve 17 to be forced as far down as permitted by the stop 19 and the aperture 17*a* is also at its lowest point.

In use or operation of the preferred embodiment, and assuming it to be initially in the position shown in FIG. 1, as the cam 41 moves about its axis, it will drive the cam follower 42 and the push rod 44 upward in the direction of arrow 46. If the pivot point of rocker arm 20 were fixed, this would normally tend to pivot the rocker arm 20 about its pivot point, thereby opening the valve 30. However, due to the fact the fulcrum member 13 slidingly engages rod 11, it is possible for it to move upward in the direction of the arrow 13*b* for a predetermined distance before that pivoting takes place. The amount of upward movement is controlled by the location of the aperture 17*a* in sleeve 17.

In this regard, as the fulcrum member 13 moves upward, some of the oil contained within the sleeve can escape through the opening 17*a*. However, once the member 13 has moved upward a sufficient distance to close off opening 17*a*, the hydraulic fluid or oil contained between the top of fulcrum member 13 and the bottom 18*a* of the housing insert 18 will be trapped in that space and the fulcrum member 13 will not be permitted any further movement.

Figure 2:
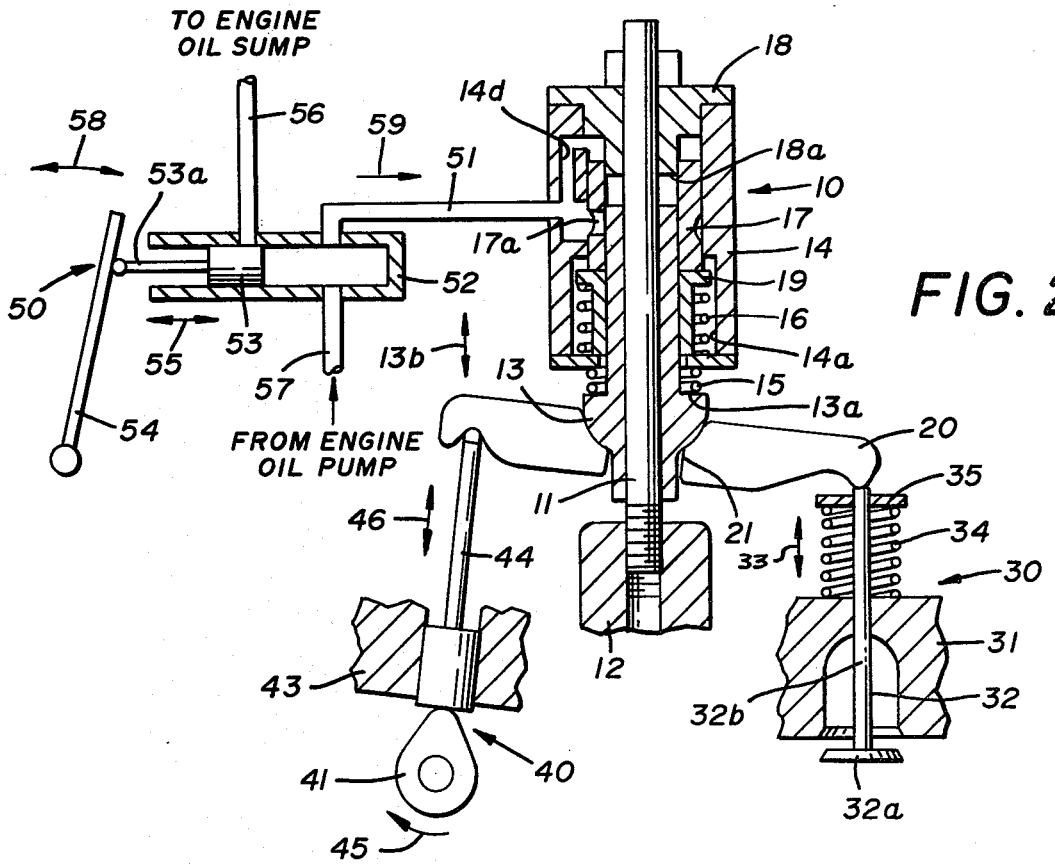
FIG. 2 is a view similar to FIG. 1 showing the preferred form of the invention during operation.

Assuming the cam 41 to be continuing its rotational movement at this point, the rocker arm 20 will pivot on fulcrum member 13, as shown in FIG. 2, driving down the valve 32 and opening the valve assembly 30 to permit the fuel to be forced into the cylinder.

The amount of pressure and the degree of movement can be controlled by the lever 54 which controls the position of piston 53 and thus the pressure of the oil in the interior of the housing 14 and also controls the vertical location of sleeve 17 and aperture 17*a*. Thus, the lever 54 actually controls the valve timing since the position of aperture 17*a* determines the amount of movement of the arm before it pivots to open the valve.

As the cam 41 continues around in its normal stroke, pressure on the end of the rocker arm 20 will begin to be relieved once the cam passes its midpoint. At that point, spring 34 will begin to close the valve and spring 15 will begin to urge the fulcrum member 13 and the rocker arm itself back to the position of FIG. 1 upon the closing of engine valve 32. When the cam has completed its movement the overall assembly will be returned to the position of FIG. 1.

In the sequence just described the maximum operational event is achieved. Since the sleeve 17 and opening 17*a* are at their lowest point fulcrum member 13 will move only briefly before pivoting occurs and thus the valve will open quickly.

Figure 3:
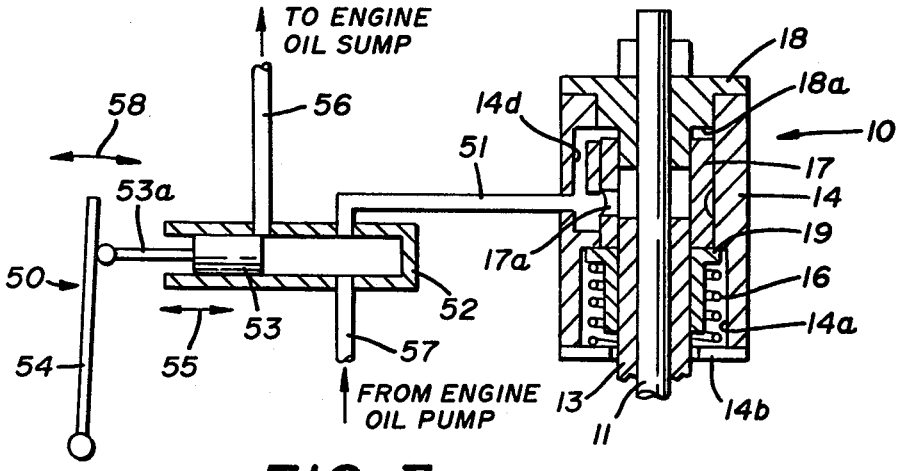
FIG. 3 is a view similar to FIG. 1, prior to operation, with the system set for medium valve opening.

Referring to FIG. 3 it will be seen that piston 53 has been moved so that line 56 is partially open. This, of course, reduces pressure in the system and permits sleeve 17 to be moved upward by spring 16. In this fashion opening 17*a* is disposed higher and, therefore, fulcrum member 13 will move further before closing off opening 17*a* and beginning its pivoting.

Therefore, it should be apparent that the position of piston 53 controls pressure within the system and ultimately controls the valve opening and that a full operational range is possible.

Figure 5:
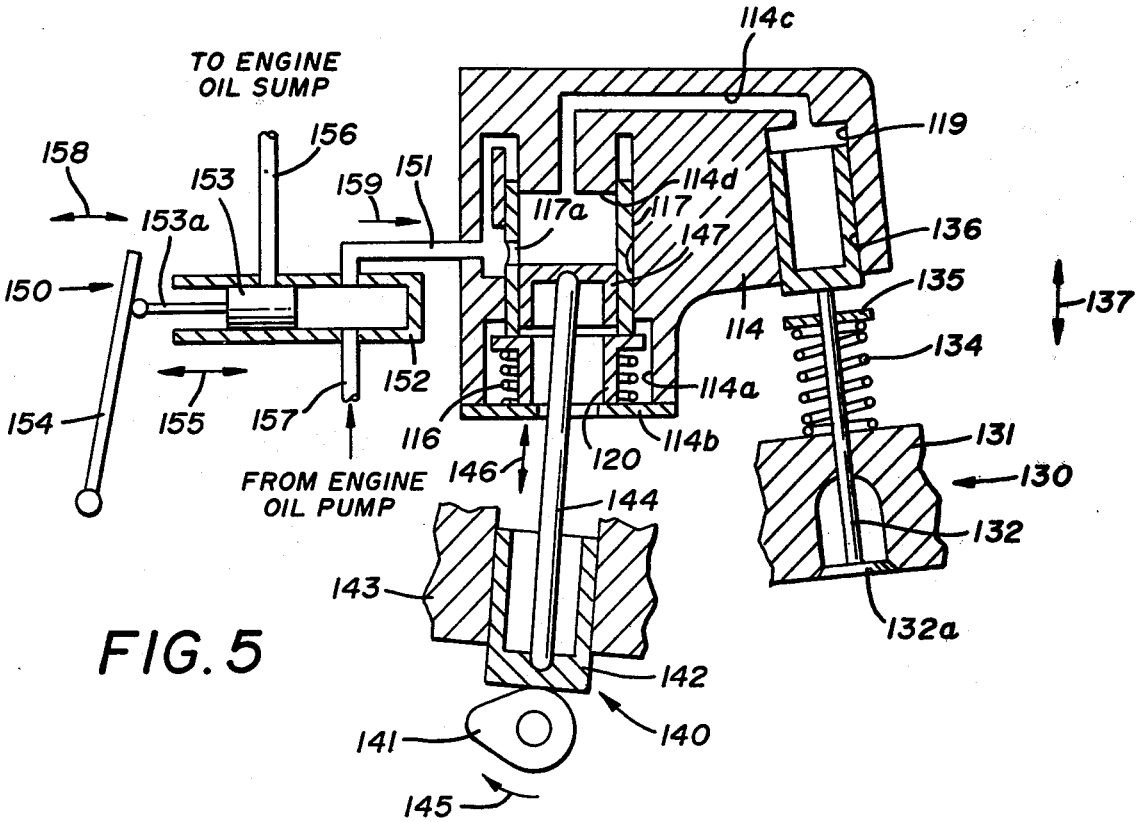
FIG. 5 is a view similar to FIG. 1 showing a modified form of the invention.

With regard to FIG. 5, a modified form of the invention is illustrated which operates essentially on the same principles but utilizes a slightly different structure.

Accordingly, and referring to FIG. 5, it will be seen that the overall assembly includes the main components of the valve body 130, the cam and cam follower 140 and the hydraulic system 150.

Again, valve assembly 130 includes a valve housing 131 and a valve stem 132 and head 132*a* movable in the direction of the arrow 137. One end of stem 132 is attached to a piston member 136. A fixed spring retainer 135 is also provided and traps a spring 134 between the plate 135 and the top of the housing 131.

The cam assembly, again, includes the cam 141 and cam follower 142 having a push rod 144 secured thereto. The end of the push rod 144 is secured to a piston 147 which is reciprocal within housing 114 in the direction of arrow 146.

In this form of the invention, the hydraulic system again includes a body 152 with a line 151 running to the main housing 114. A first line 157 connects the engine oil pump while a second line 156 leads to the engine sump.

The piston 153 is reciprocally received within the body 152 and has a projecting rod 153a which is secured to the lever 154. Again, the lever is movable in the direction of the arrow 158 to control the pressure of the oil within the system as it is forced, by the oil pump from the body 152 through the line 151 into the main housing and again, the piston in FIG. 5 is shown in a position whereby maximum pressure is supplied by the oil pump.

In the main housing, a first internal bore 114*a* is provided having a ledge 114*b* at the bottom thereof. A spring 116 is trapped between that ledge and the bottom of the sleeve 117. Similar to the embodiment shown in FIG. 1, the sleeve 117 is slidable within the housing and has an aperture 117a therein for purposes which will be described below. A flanged bushing 120 is also employed to limit downward movement.

It should be noted that main housing 114 also has a through passage 114*c* which leads to bore 119 within which is receiving the cup-shaped slave piston member 136.

In use or operation of the form of the invention shown in FIG. 5, movement of the cam 141 in response to the crankshaft movement in the direction of the arrow 145 will force the cam follower 142 and push rod 144 upward in the direction of arrow 146. It will, of course, be apparent that lever 154 has been actuated, to assure maximum oil pressure in the body 114; and this oil will be acting on the top of the sleeve 117 to position it. This oil also will be forced through aperture 117*a* into the space between the top of the member 147 and the top of the bore 114*d*. This form of the invention is essentially completely hydraulically controlled, and continued movement of the cam and thereby the piston 147 in the upward direction will eventually close off opening 117*a*. At that point, the oil trapped between the top of the member 147 will be forced under increased pressure through passageway 114*c* and into opening 119.

At that time, this oil will act on the piston 136 to drive the valve 132 downward and thereby open the valve permitting the fuel to enter the valve for combustion purposes.

Again, timing of valve 132 is essentially controlled by lever 154 and the pressure in the system.

Continuing movement of the cam will allow the cam follower to return to the position in FIG. 5 and, of course, the spring 134 will automatically overcome the normal oil pressure in the system and close the valve 132.

The form of the invention shown in FIG. 5 has only been illustrated in the "maximum" position but it is believed apparent that a full range of operation is also possible depending on the position of piston 153.

It should also be apparent that, while the rocker arm has been eliminated in the modified form of the invention that the control principle remains the same.

While a full and complete description of the invention has been set forth in accordance with the dictates of the Patent Statutes, it should be understood that modifications can be resorted to without departing from the spirit hereof or the scope of the appended claims.

Thus, while the invention has been described primarily in connection with intake valves the same principles could be applied to exhaust valves. Also, the invention is applicable to both spark and diesel ignition engines.

What is claimed is:

1. Means for controlling the operational event of valves in internal combustion engines which are activated by the conversion of the rotary motion of a cam shaft into linear motion of a cam follower, comprising:

(A) a housing having a central blind bore opening into one face thereof;

(B) a variable hydraulic system;

(C) said housing having a passageway interconnecting said hydraulic system and said central bore;

(D) a cylindrical sleeve slidably received within said blind bore and having a through radial aperture variably positionable within said bore, (1) whereby hydraulic fluid may be introduced into said housing to control the position of said sleeve and the location of said radial aperture therein;

(E) a rocker arm operatively interconnecting the cam shaft and the valve and mounted for pivotal movement; and (F) a control member (1) resting on said rocker arm, (2) slidably received within said sleeve, and (3) movable in response to linear movement of the cam follower and said rocker arm to close off said radial aperture in said sleeve and trap said fluid in said blind bore, (a) whereby further linear movement of said rocker arm is prevented by said fluid and pivotal movement is permitted.

2. The means of claim 1 further characterized by the presence of (A) tension means acting on said control member and normally urging said member away from said blind bore.

3. The means of claim 1 further characterized by the presence of (A) a stop member (19) slidably received within said blind bore; and (B) said sleeve having one end resting on said stop member.

4. The means of claim 1 wherein said variable hydraulic system includes (A) a source of hydraulic fluid under pressure;

(B) a tubing network interconnecting said source and said passageway of said housing; and (C) means for varying the pressure on said fluid within said tubing network and said passageway.

* * * * *